US007703394B2

(12) United States Patent
Neuhaus

(10) Patent No.: US 7,703,394 B2
(45) Date of Patent: Apr. 27, 2010

(54) APPARATUS AND METHOD FOR THE APPLICATION OF A LIQUID AND PRINTING UNIT AND MACHINE HAVING THE APPARATUS

(75) Inventor: Dietmar Neuhaus, Düsseldorf (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 587 days.

(21) Appl. No.: 11/438,870

(22) Filed: May 23, 2006

(65) Prior Publication Data

US 2006/0260542 A1 Nov. 23, 2006

(30) Foreign Application Priority Data

May 23, 2005 (DE) ..... 10 2005 023 733

(51) Int. Cl.
*B41F 31/02* (2006.01)

(52) U.S. Cl. ..... 101/364; 101/350.1; 101/350.5; 101/367

(58) Field of Classification Search ..... None
See application file for complete search history.

(56) References Cited

U.S. PATENT DOCUMENTS

| | | | | |
|---|---|---|---|---|
| 4,675,208 | A | 6/1987 | Kageyama et al. | |
| 5,674,571 | A | 10/1997 | Focke et al. | |
| 5,768,993 | A | 6/1998 | Stuart | |
| 6,516,720 | B2 * | 2/2003 | Cheung et al. | 101/483 |
| 6,553,200 | B2 | 4/2003 | Hiraoka et al. | |
| 6,575,092 | B1 | 6/2003 | Harenbrock et al. | |
| 6,651,560 | B2 | 11/2003 | Neuhaus | |
| 6,857,367 | B2 * | 2/2005 | Heller et al. | 101/483 |
| 6,928,927 | B2 * | 8/2005 | Endo | 101/153 |

FOREIGN PATENT DOCUMENTS

| | | | |
|---|---|---|---|
| DE | 2 79 952 | C | 10/1914 |
| DE | 6 22 359 | C | 12/1935 |
| DE | 19 43 439 | U | 8/1966 |
| DE | 19 78 657 | U | 2/1968 |
| DE | 34 47 510 | A1 | 7/1985 |
| DE | 198 60 641 | A1 | 7/2000 |
| EP | 0 738 594 | | 10/1996 |
| EP | 1 154 905 | B1 | 11/2001 |
| WO | 2006/016107 | A1 | 2/2006 |

* cited by examiner

*Primary Examiner*—Jill E Culler
(74) *Attorney, Agent, or Firm*—Laurence A. Greenberg; Werenr H. Stemer; Ralph E. Locher

(57) ABSTRACT

An apparatus and a method for the non-contact, metered application of a liquid, for example a printing ink, to the surface of a cylinder, include an application device which has at least one exit opening for the liquid. An extraction device has at least one entry opening for excess liquid. The excess liquid preferably passes substantially directly from the exit opening to the entry opening. A printing unit and a machine having the apparatus are also provided.

33 Claims, 4 Drawing Sheets

APPARATUS AND METHOD FOR THE APPLICATION OF A LIQUID AND PRINTING UNIT AND MACHINE HAVING THE APPARATUS

BACKGROUND OF THE INVENTION

Field of the Invention

The present invention relates to an apparatus for the non-contact, metered application of a liquid, including an application device having at least one exit opening for the liquid. The present invention also relates to a printing unit, in particular a planographic or gravure printing unit, having a cylinder. The present invention additionally relates to a machine processing printing material, in particular a printing press or planographic or gravure press. The present invention furthermore relates to a method for the non-contact, metered application of a liquid, in which the liquid is supplied from at least one exit opening of an application device.

European Patent EP 1 154 905 B1, corresponding to U.S. Pat. No. 6,651,560 B2, discloses a controllable printing form for transferring free-flowing printing ink to a printing material. The printing form 6 has a surface provided with a pattern of openings. The openings are provided to pick up printing ink 15 in a trough 16. Separately controllable cavities 2 which have heating elements and are located behind the openings contain a gas filling, that is expanded by heating and, during subsequent cooling, sucks printing ink into the cavities. Excess printing ink is wiped off the surface of the printing form by a metering doctor 18. After the surface of the printing form has been brought into contact with a printing material 19, the gas filling is heated again, so that the printing ink emerges from the cavities and is transferred to the printing material.

The surface of the printing form can be subjected to wear as a result of doctoring off the excess printing ink. In addition, the action of doctoring off the excess printing ink can be unsatisfactory and thus too much printing ink can reach the printing material, in particular at actually ink-free points.

German Utility Model DE 19 43 939 discloses an inking unit for printing presses which is constructed as a so-called ink bar. In that case, printing ink is applied to an applicator roll as a continuous film through the use of a nozzle 1 which, for example, is formed as a flat nozzle and is disposed at a distance of at most 3 mm from the circumferential surface of the applicator roll.

In addition, German Utility Model 19 78 657 U describes an ink bar disposed at a short distance from an ink applicator roll. Likewise, German Published, Non-Prosecuted Patent Application DE 198 60 641 A1, corresponding to U.S. Pat. No. 6,575,092 B1, describes an ink supply device 02 provided with a slot nozzle 16, which applies a uniform ink film to the circumferential surface 31 of an ink ductor 01.

The ink bars disclosed by the prior art are thus always used in inking units to apply continuous and uniform ink films.

German Published, Non-Prosecuted Patent Application DE 36 08 944 A1, on the other hand, describes a metering apparatus operating without contact for inking and dampening solution rolls on printing presses. An ink film initially applied continuously to an engraved roll 1 is treated by a preliminary doctor 4 and subsequently partly removed through the use of a suction bar 3 disposed at a short distance at a position remote from an ink application unit or from the preliminary doctor.

External air which is taken in overcomes the adhesion of the printing ink that is not doctored off by the preliminary doctor 4 to edges of pattern webs as well as cohesion of ink molecules to one another and tears ink molecules both out of printing pattern cells and from the pattern web edges as a function of the suction being applied.

The apparatus described, including an ink applicator unit which is neither illustrated nor described, the preliminary doctor and the suction bar, occupies a large amount of overall space on the circumference of the roll, because of the large number of components and the respective spacing of the components from one another.

SUMMARY OF INVENTION

It is accordingly an object of the invention to provide an apparatus and a method for the application of a liquid and a printing unit and a machine having the apparatus, which overcome the hereinafore-mentioned disadvantages of the heretofore-known apparatuses and methods of this general type and which make it possible to meter the liquid application in the desired way.

It is a further or alternative object of the present invention to provide an apparatus and a method for the application of a liquid, in which it is impossible for the surface of an object to which the liquid is applied to be damaged by the apparatus or by the method being applied.

It is also a further or alternative object of the present invention to provide an apparatus for the application of a liquid which requires little space.

With the foregoing and other objects in view there is provided, in accordance with the invention, an apparatus for the non-contact, metered application of a liquid. The apparatus comprises an application device having at least one exit opening for the liquid. An extraction device has at least one entry opening for excess liquid.

As opposed to conventional application apparatuses, which require contact with the object subject to the liquid application, for example in order to bring about liquid metering by doctoring off, an application apparatus according to the invention operates without contact, that is to say it is only the liquid to be applied but not components of the apparatus which contact the object. In this way, damage to the object, in particular to its surface, can advantageously be avoided.

As is also opposed to conventional application apparatuses, which apply a liquid through an opening, for example a slot nozzle of an application bar, an application apparatus according to the invention also has an entry opening for excess liquid in addition to an exit opening for the liquid to be applied. In this application, the term "excess liquid" is to be understood to mean that liquid which flows out through the exit opening during the application operation but is not applied or does not remain applied, for example that liquid which flows into the entry opening from the exit opening without contact with the object subject to the liquid application, or that liquid which, although it contacts the object briefly, does not reach the entry opening in the active range of the application apparatus. The application can advantageously be metered, as a result of the provision according to the invention, both of an exit opening and of an entry opening. Furthermore, as a result of the provision both of an exit opening and of an entry opening, the advantage results that an apparatus according to the invention is constructed in a space-saving manner as compared with known apparatuses, since, for example, no separate preliminary doctor is needed.

In accordance with another feature of the invention, which is optimized with regard to an effective and controllable extraction operation, the extraction device takes in a gas, in particular ambient air, in such a way that the excess liquid is carried away together with the gas. The gas which is taken in is advantageously used for the purpose of providing an extraction flow that entrains the excess liquid, for example as drops, and prevents too much liquid from reaching the object subject to the liquid application. Furthermore, through the use of the gas flow, a seal can advantageously be created between the application apparatus and the object. The seal only allows the desired quantity of liquid through.

In accordance with a further feature of the invention, which is optimized with regard to an effective and controllable liquid application, a control device controls the supply of the liquid through the exit opening and the extraction of the gas through the entry opening in such a way that the excess liquid passes substantially directly from the exit opening to the entry opening and/or that a liquid column with a substantially stable free interface with the gas is formed in front of the exit opening. In this application, in this connection, the term "directly" is to be understood to mean that the liquid reaches the entry opening either without previous contact or after only brief contact with the object. In particular, "directly" means that the liquid substantially reaches the entry opening without any transport provided by the object or the surface of the latter. As a result of the direct flow from the exit opening to the entry opening, for example in the manner of a fountain, an advantageously space-saving apparatus can in turn be provided which, in addition, permits the liquid application to be controlled precisely. The formation of a substantially stable free interface of the liquid with the gas also assists the precise controllability since, in this way, the liquid column has a defined size and permits the specific application of a defined quantity of liquid.

The apparatus according to the invention is preferably disposed underneath the object subject to the liquid application, so that the liquid column forms above the apparatus according to the invention and, in particular, functions in the manner of a fountain, that is to say the liquid rises from the exit opening and falls into the entry opening.

In accordance with an added feature of the invention, which is optimized with regard to the reduced space required, the application device and the extraction device are disposed adjacently, in particular immediately adjacently, and/or the application device and the extraction device have at least one common dividing wall and/or the application device is integrated into the extraction device. Since there is often a considerable lack of space, in particular in inking, varnishing or dampening units of printing presses, the adjacent, in particular immediately adjacent, configuration is of particular advantage. The provision of a common dividing wall can, moreover, permit an additional gain in space. Finally, as a result of the integration, the space required for the apparatus according to the invention is advantageously reduced in an extraordinary way. In addition, the advantage results that supply lines for the liquid and the vacuum only have to be led to one apparatus and not at remote points. Possible removal of the apparatus for maintenance or cleaning purposes is also facilitated by the integration. If an adjustment of the distance from the apparatus to the object has to be carried out in order to set application parameters, this is likewise considerably easier as a result of the integration than in the case of separate application and extraction devices.

In accordance with an additional feature of the invention, which is optimized with regard to a defined and uniform application, the exit opening of the application device and the entry opening of the extraction device are in each case formed as a slot nozzle, in particular as a segmented slot nozzle. A uniform application over the length of the apparatus is advantageously achieved as a result of the provision of a segmented slot nozzle. In this case, the number and the spacing of the segment dividing walls are chosen in such a way that a desired uniform application is achieved.

With the objects of the invention in view, there is also provided a printing unit, in particular a planographic or flatbed or gravure printing unit, comprising a cylinder having a surface. An apparatus according to the invention, in particular being substantially equal in length to the cylinder, is disposed at a distance from the cylinder for application of a printing liquid, in particular ink, varnish or dampening solution, to the surface of the cylinder.

In accordance with another feature of the invention, which is optimized with regard to the liquid application to the cylinder surface and is defined and/or controllable in terms of its quantity, the surface of the cylinder has depressions, in particular engraved cells. Furthermore, the cells can be constructed as suction cells.

With the objects of the invention in view, there is additionally provided a machine for processing printing material, in particular a printing press or a planographic or gravure printing press, comprising at least one apparatus according to the invention or at least one printing unit according to the invention.

With the objects of the invention in view, there is also provided a method for the non-contact, metered application of a liquid. The method comprises supplying the liquid from at least one exit opening of an application device. Excess liquid is carried away through at least one entry opening of an extraction device.

In accordance with a concomitant feature of the invention, which is optimized with regard to the precise and easily controlled application, the excess liquid passes substantially directly from the exit opening to the entry opening.

The method according to the invention and its preferred embodiment are associated with advantages as described above with reference to the apparatus according to the invention.

Other features which are considered as characteristic for the invention are set forth in the appended claims.

Although the invention is illustrated and described herein as embodied in an apparatus and a method for the application of a liquid and a printing unit and a machine having the apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
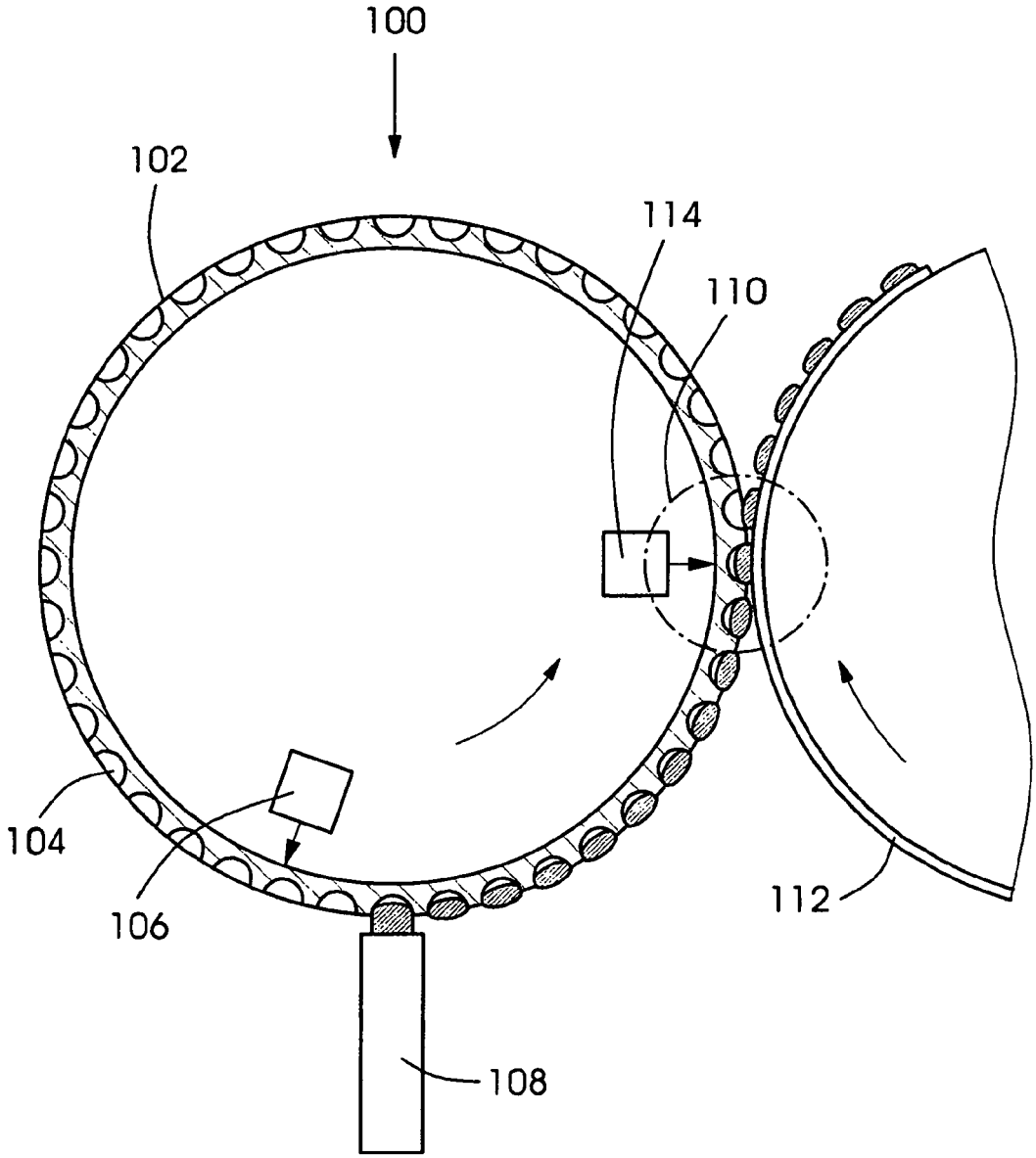
FIG. 1 is a fragmentary, diagrammatic, sectional view of an embodiment of a printing unit according to the invention.

Referring now to the figures of the drawings in detail and first, particularly, to FIG. 1 thereof, there is seen a so-called suction printing form 100 which is constructed as a cylinder and can be imaged digitally. The printing form 100 has a periphery 102 in which there are a large number of digitally controllable, switchable cells 104 disposed in a pattern. The cells 104 can be heated, for example from the inside by a laser heating device 106, in accordance with information from an image to be printed, so that air located in them is heated and expands. During a following cooling operation, the heated cells run past a compact application device 108 according to the invention for a non-contact, metered application of liquid, in particular printing ink. In the process, printing ink is transferred or sucked into the cells by contracting air (suction printing form). Since the surface of the printing form 100 preferably has an ink-repelling construction at points (pattern webs) surrounding openings of the cells, no printing ink is transferred to these points but only to points of the cells (pattern) 104 themselves. In a region 110 in which the printing form 100 contacts a printing material 112, the cells 104 and the air in them are heated again by a laser heating device 114 and the printing ink is expelled by the expansion of air and transferred to the printing material 112.

Figure 2:
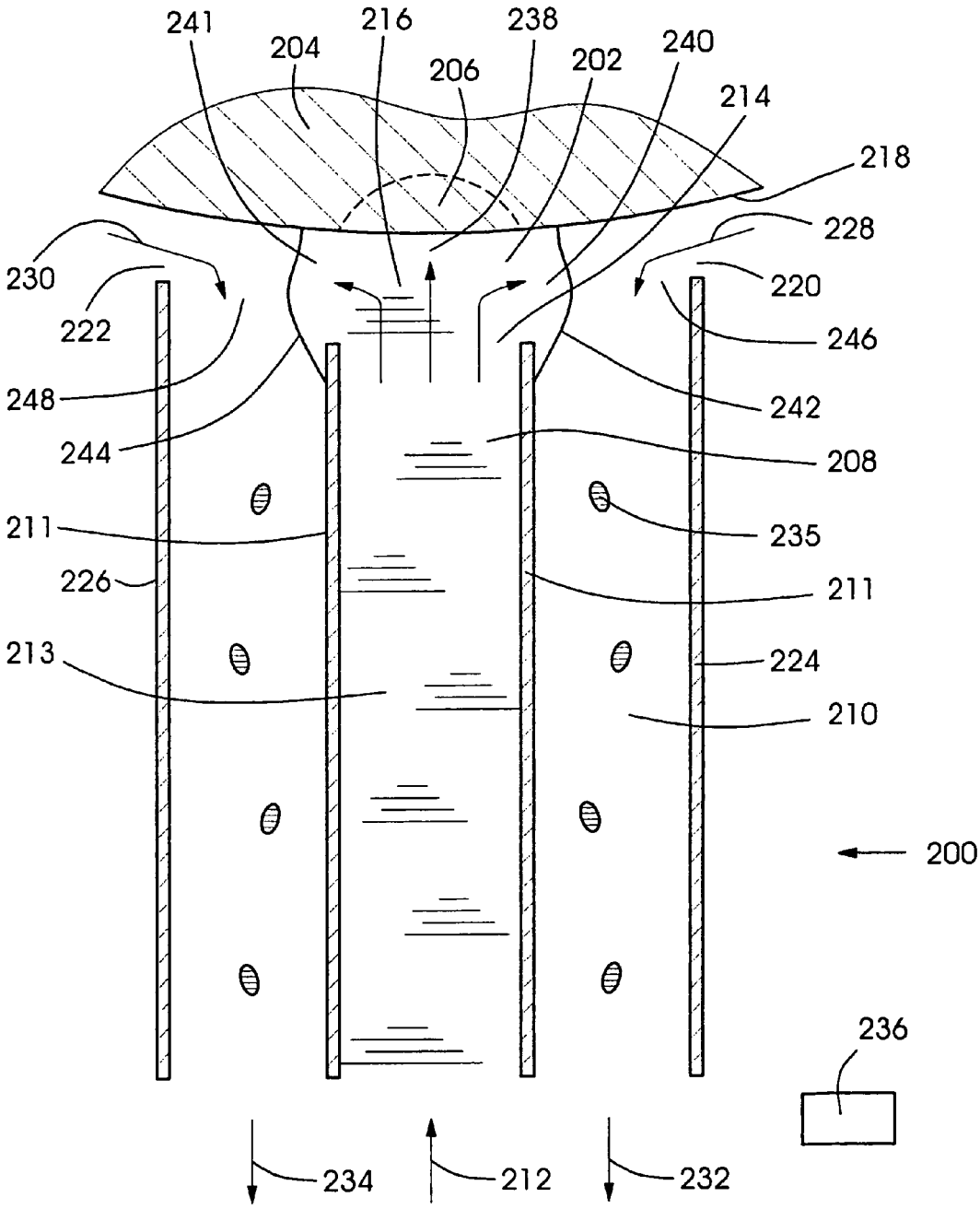
FIG. 2 is a fragmentary, sectional view of an embodiment of an apparatus according to the invention.

FIG. 2 illustrates an application apparatus 200 according to the invention (comparable to the compact apparatus 108 in FIG. 1) for the application of printing ink 202 to a cylinder 204 or into surface cells 206 of the cylinder 204.

The apparatus 200 has an internal application device 208, that is to say one disposed or integrated on the inside, and an outer extraction device 210, that is to say one disposed on the outside, surrounding the former. The application device 208 is formed as a slot nozzle having two walls 211 and is connected to a non-illustrated supply device for low-viscosity, in particular thin, printing ink 213 (comparable with a gravure printing ink). The printing ink 213 is thus supplied to the application device 208 in a direction 212 (from below in the structure and orientation illustrated in FIG. 2) and emerges from the application device 208 through an exit opening 214 opposite a cylinder surface 218. An ink column 216, which forms in front of (above in the structure and orientation illustrated in FIG. 2) the exit opening 214, reaches as far as the surface 218 of the cylinder 204 and contacts the surface 218, while the walls 211 are disposed without contact with the surface 214, that is to say at a distance from the surface 214.

The extraction device 210, which is formed as a slot nozzle, has two further (outer) walls 224 and 226 in addition to the common dividing walls 211, and is connected to a non-illustrated vacuum source, so that ambient air can be taken in through spacing gaps 220 and 222 between the respective walls 224 and 226 and the surface 218 of the cylinder 204. A respective air stream 228 and 230 (on the right and left, that is to say in the direction of movement and counter to the direction of movement of the cylinder surface, in the structure and orientation illustrated in FIG. 2) which is produced leads past interfaces of the ink column 216 in the upper region of the extraction device 210 and reaches the vacuum source in respective directions 232 and 234 (downward in the structure and orientation illustrated in FIG. 2). In flowing past the ink column 216, the air stream 228 or 230 entrains printing ink as droplets 235 or as a stream of ink and carries the droplets or stream away in the direction 232 or 234.

The functioning, i.e. the applied application method of the apparatus according to the invention, is then as follows: Firstly the supply, for example the respective quantity per unit time, of the printing ink 213 and secondly the extraction of the air 228 and 230, can be controlled by a control device 236. A free interface 242, 244 of the column 216, that is to say the interface between the printing ink 213 and the ambient air 228 and 230, can substantially be stabilized specifically both in space and time, through the use of a suitable choice between, for example, the inflow velocity of the printing ink 213 and the vacuum applied to the extraction device, given predefined diameters of the nozzles 208 and 210 and a given distance between the apparatus 200 and the surface 218. This is advantageous, since the apparatus 200 then only covers a physically limited surface section of the surface 218 with printing ink, and a finely metered application can be carried out.

The greatest pressure prevails in the ink column 216 between the surface 218 and the exit opening 214 close to the surface 218, at a stagnation point 238 of the printing ink jet. In an edge region 240 and 241 of the ink column 216, that is to say in a region between the dividing wall 211 and the surface 218, the flow velocity of the printing ink is also determined by the suction through an entry opening 246 of the extraction device 210. The pressure in the edge region 240 and 241 of the ink column 216 is lower, because of the greater flow velocity of the printing ink there (Bernoulli pressure equation) than at the stagnation point 238. The physical position of the free interface 242 or 244 between the printing ink and the ambient air is stable if, in the interface 242 or 244, the compressive forces prevailing and the forces resulting from the surface tension of the ink column 216 compensate for one another. The respective compressive forces can be changed or controlled specifically by way of the flow velocity, both in the inflow of the printing ink and in the outflow of the ambient air.

The extraction velocity of the printing ink in the edge region 240 or 241 of the ink column 216 is determined by the vacuum applied to the extraction device 210 and by an overhang or excess of the printing ink, resulting from the physical position of the free interface 242 or 244, in the respective gap between the respective dividing wall 211 and the cylinder surface 218. An enlargement of the overhang or excess in the gap region narrows the respective entry opening 246 or 248 of the extraction device 210 and, in this way, with a given vacuum, increases the extraction rate in the gap and therefore the extraction velocity of the printing ink in the edge region 240 or 241 of the ink column 216.

On one hand, for example, if the applied vacuum is increased, then initially the extraction rate increases, the extraction velocity in the edge region of the ink column increases, the pressure in the edge region of the ink column decreases and the pressure in the surrounding atmosphere is able to shift the interface between the printing ink and the atmosphere in the direction of the center of the ink column. The consequence of displacing the interface is that the overhang or excess of the printing ink is reduced, the extraction rate decreases as a result and, ultimately, a new stable position of the interface is formed therefrom. The new stable position of the interface is closer to the center of the ink column than before the increase in the applied vacuum. The relationship described between the extraction rate and the overhang or excess of the printing ink consequently stabilizes the interface between the printing ink and the surrounding atmosphere. On the other hand, if the applied vacuum is reduced, then the free interface is stabilized at a position more remote from the center of the ink column.

Figure 3:
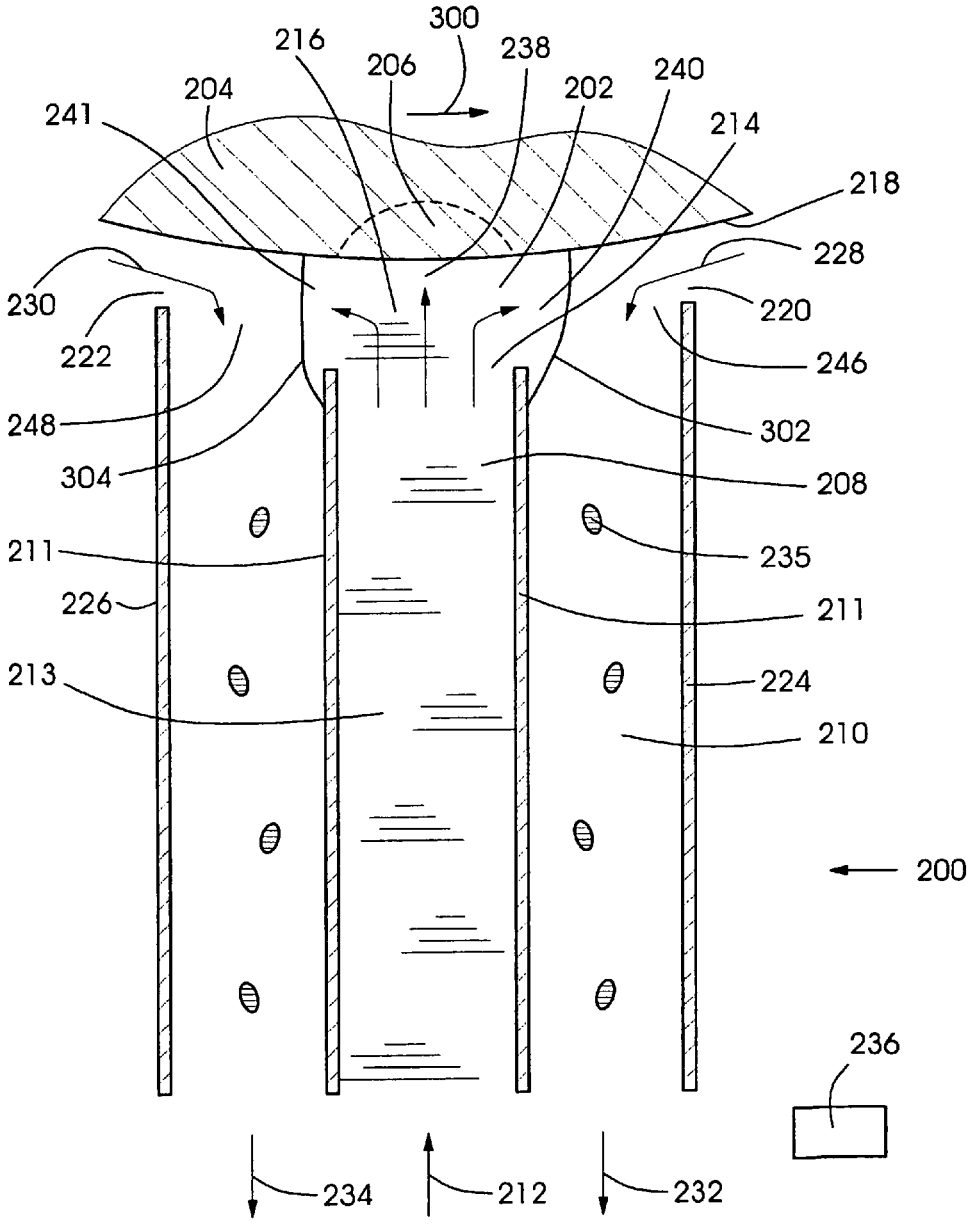
FIG. 3 is a view similar to FIG. 2 of a further embodiment of the apparatus according to the invention.

FIG. 3 shows the application apparatus 200 and the cylinder surface 218 being moved relative to the apparatus 200 over the ink column 16. The printing ink 213 exerts an at least low adhesive force on the surface 218, which leads to the ink column 16 being deflected in the direction of movement 300 of the surface 218. The deflection of the ink column 216 is limited by the overhang or excess of the printing ink in the gap between the wall 211 and the cylinder surface 218 being increased on the side of the ink column 216 which points in the direction of movement 300. As already described, the increased overhang or excess leads to an increased extraction rate and therefore to an increased flow velocity in the edge region of the ink column 216, which means that the pressure in the edge region of the ink column 216 falls. As a result of the then relatively greater external pressure, the interface 302 is forced back and the position of the interface 302 is in turn stabilized but at a position displaced in the direction of movement 300 as compared with FIG. 2.

On the side of the ink column 216 pointing in the direction opposite to the direction of movement 300, once more a free interface 304 between the printing ink and the ambient air is moved in the direction of movement 300 of the surface 218, because of the adhesive force between the printing ink 213 and the surface 218. The effect of this is that the overhang or excess of the printing ink in the gap becomes smaller, which means that the flow velocity in this edge region of the ink column 216 decreases, which leads to the pressure in the edge region of the printing ink rising. Consequently, the position of the free interface 304 of the ink column 216 is also stabilized but at a position displaced in the direction of movement 300 as compared with FIG. 2.

Surprisingly, it thus transpires that, even given rapid rotation of the cylinder, that is to say during movement of the surface 218 relative to the ink column, adequate stabilization of the free interfaces 302 and 304 can be achieved by the control system. Due to the stabilized ink column, the apparatus according to the invention can be used for specific filling of the cells 206 and, at the same time, it is possible to avoid an application of a closed ink film, as compared with known ink bars.

Figure 4:
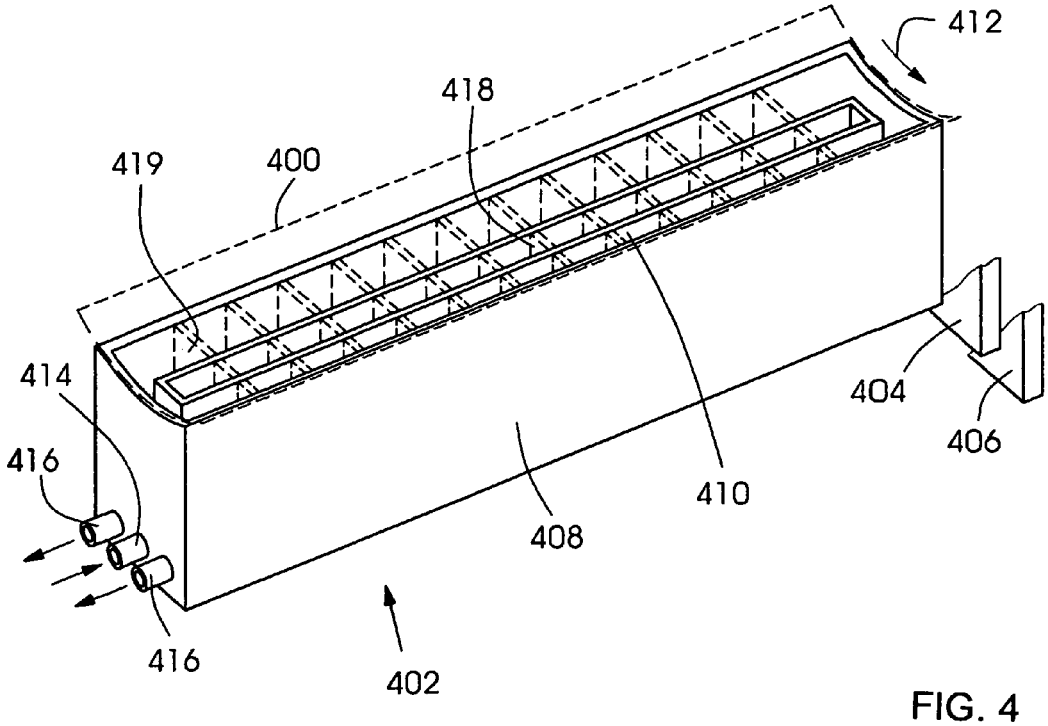
FIG. 4 is a perspective view of an embodiment of an apparatus according to the invention.

FIG. 4 shows an embodiment of the apparatus according to the invention in a perspective illustration, in which a surface 400 of the cylinder is illustrated in dashed lines for clarity.

An application apparatus 402, which is disposed in a printing unit 404 of a press 406 (only a section of both of which is illustrated for clarity), extends substantially over an axial length of the cylinder, but at least in the axial direction over an extent of the cylinder acting as a printing area.

An inner application device 410 is integrated into an outer extraction device 408 in such a way that the application device 410 is surrounded by a suction region, at least in a direction of movement 412, although the suction region preferably encloses the application device 410 counter to the direction of movement 412 as well. Furthermore, as illustrated, the suction region can also enclose the areas of the application device 410 located at the sides in the axial direction, in other words the application device 410 can be embedded completely in a suction region.

As is illustrated by the dashed lines, the application device 410 can be provided with webs 418, that is to say it is segmented, in order to achieve the most uniform flow of printing ink. Printing ink is supplied to the apparatus 402 through a connection 414, and extracted air is carried away through a connection or connections 416. The illustrated compact modular construction is advantageously used to reduce the required space.

As is illustrated by dashed lines, the extraction device 408 can also be provided with webs 419, that is to say it is segmented, in order to achieve the most uniform extraction.

This application claims the priority, under 35 U.S.C. § 119, of German Patent Application DE 10 2005 023 733.9, filed May 23, 2005; the prior application is herewith incorporated by reference in its entirety.

I claim:

1. An apparatus for the non-contact, metered application of a liquid, the apparatus comprising:

an application device having at least one exit opening for the liquid; and an extraction device having at least one entry opening for excess liquid, said extraction device taking in a gas, and the excess liquid being carried away together with the gas; and a control device controlling a supply of the liquid through said exit opening and an extraction of the gas through said entry opening and causing the excess liquid to pass substantially directly from said exit opening to said entry opening and causing a liquid column with a substantially stable free interface with the gas to form upstream of said exit opening.

2. The apparatus according to claim 1, wherein the gas is ambient air.

3. The apparatus according to claim 1, wherein said control device causes a liquid column with a substantially stable free interface with the gas to form upstream of said exit opening.

4. The apparatus according to claim 1, wherein said application device and said extraction device are mutually adjacently disposed.

5. The apparatus according to claim 4, wherein said application device and said extraction device are mutually immediately adjacently disposed.

6. The apparatus according to claim 1, wherein said application device and said extraction device have at least one common dividing wall.

7. The apparatus according to claim 1, wherein said application device is integrated into said extraction device.

8. The apparatus according to claim 1, wherein said application device and said extraction device are mutually adjacently disposed, and said application device and said extraction device have at least one common dividing wall.

9. The apparatus according to claim 8, wherein said application device and said extraction device are mutually immediately adjacently disposed.

10. The apparatus according to claim 1, wherein said application device and said extraction device are mutually adjacently disposed, and said application device is integrated into said extraction device.

11. The apparatus according to claim 10, wherein said application device and said extraction device are mutually immediately adjacently disposed.

12. The apparatus according to claim 1, wherein said application device and said extraction device have at least one common dividing wall, and said application device is integrated into said extraction device.

13. The apparatus according to claim 1, wherein said application device and said extraction device are mutually adjacently disposed, said application device and said extraction device have at least one common dividing wall, and said application device is integrated into said extraction device.

14. The apparatus according to claim 13, wherein said application device and said extraction device are mutually immediately adjacently disposed.

15. The apparatus according to claim 1, wherein said exit opening and said entry opening are each formed as a respective slot nozzle.

16. The apparatus according to claim 15, wherein each slot nozzle is a segmented slot nozzle.

17. A printing unit, comprising:

a cylinder having a surface; and an apparatus according to claim 1 disposed at a distance from said cylinder for application of a printing liquid to said surface of said cylinder.

18. The printing unit according to claim 17, wherein said apparatus is substantially equal in length to said cylinder.

19. The printing unit according to claim 17, wherein the printing liquid applied by said apparatus is selected from the group consisting of ink, varnish and dampening solution.

20. The printing unit according to claim 17, wherein said surface of said cylinder has depressions formed therein.

21. The printing unit according to claim 20, wherein said depressions are engraved cells.

22. The printing unit according to claim 17, wherein the printing unit is a planographic printing unit.

23. The printing unit according to claim 17, wherein the printing unit is a gravure printing unit.

24. A machine for processing printing material, comprising at least one printing unit according to claim 17.

25. The machine according to claim 24, wherein the machine is a printing press.

26. The machine according to claim 24, wherein the machine is a planographic printing press.

27. The machine according to claim 24, wherein the machine is a gravure printing press.

28. A machine for processing printing material, comprising at least one apparatus according to claim 1.

29. The machine according to claim 28, wherein the machine is a printing press.

30. The machine according to claim 28, wherein the machine is a planographic printing press.

31. The machine according to claim 28, wherein the machine is a gravure printing press.

32. An apparatus for the non-contact, metered application of a liquid, the apparatus comprising:

an application device having at least one exit opening for the liquid; and an extraction device having at least one entry opening for excess liquid, said extraction device taking in a gas, and the excess liquid being carried away together with the gas; and a control device controlling a supply of the liquid through said exit opening and an extraction of the gas through said entry opening and causing a liquid column with a substantially stable free interface with the gas to form upstream of said exit opening.

33. A method for the non-contact, metered application of a liquid, the method comprising the following steps:

supplying the liquid from at least one exit opening of an application device;

carrying excess liquid away through at least one entry opening of an extraction device by the extraction device taking in a gas and carrying the excess liquid away together with the gas;

controlling, via a control device, a supply of the liquid through the exit opening and an extraction of the gas through the entry opening and causing the excess liquid to pass substantially directly from the exit opening to the entry opening and causing a liquid column with a substantially stable free interface with the gas to form upstream of said exit opening.

* * * * *